US012497708B2

(12) United States Patent
Kwon et al.

(10) Patent No.: US 12,497,708 B2
(45) Date of Patent: Dec. 16, 2025

(54) ELECTROGALVANIZED STEEL SHEET HAVING SUPERB WHITENESS AND METHOD FOR MANUFACTURING SAME

(71) Applicant: POSCO, Pohang-si (KR)

(72) Inventors: Moon-Jae Kwon, Gyeongsangbuk-do (KR); Su-Young Kim, Gyeongsangbuk-do (KR); Chan-Seok Bang, Gyeongsangbuk-do (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 17/786,990

(22) PCT Filed: Dec. 3, 2020

(86) PCT No.: PCT/KR2020/017511
§ 371 (c)(1),
(2) Date: Jun. 17, 2022

(87) PCT Pub. No.: WO2021/125635
PCT Pub. Date: Jun. 24, 2021

(65) Prior Publication Data

US 2023/0027626 A1 Jan. 26, 2023

(30) Foreign Application Priority Data

Dec. 20, 2019 (KR) ..... 10-2019-0171529

(51) Int. Cl.

| | |
|---|---|
| ***C25D 5/12*** | (2006.01) |
| ***C25D 3/12*** | (2006.01) |
| ***C25D 3/22*** | (2006.01) |
| ***C25D 5/00*** | (2006.01) |
| ***C25D 5/36*** | (2006.01) |

(52) U.S. Cl.
CPC ..... *C25D 5/12* (2013.01); *C25D 3/12* (2013.01); *C25D 3/22* (2013.01); *C25D 5/36* (2013.01); *C25D 5/627* (2020.08)

(58) Field of Classification Search
CPC ..... B32B 15/015; C25D 3/22; C25D 5/12; C25D 5/36; C25D 5/627
See application file for complete search history.

(56) References Cited

U.S. PATENT DOCUMENTS 4,064,320 A 12/1977 Adaniya et al.
2010/0098939 A1* 4/2010 Tada ..... C23C 28/00 428/336

FOREIGN PATENT DOCUMENTS

| | | | |
|---|---|---|---|
| IN | 333208 | | 9/2018 |
| JP | S60-200997 | A | 10/1985 |
| JP | S61-166992 | A | 7/1986 |
| JP | H05-222598 | A | 8/1993 |

(Continued)

OTHER PUBLICATIONS

Machine translation of JPH08-24958A (published Jan. 1996), Powered by EPO and Google. (Year: 1996).*

(Continued)

*Primary Examiner* — Monique R Jackson
(74) *Attorney, Agent, or Firm* — MORGAN, LEWIS & BOCKIUS LLP

(57) ABSTRACT

The present invention provides an electrogalvanized steel sheet and a method manufacturing same, the electrogalvanized steel sheet having superb whiteness, and an attractive exterior surface due to reduction in surface scale.

3 Claims, 1 Drawing Sheet

(a)

(b)

(56) References Cited

FOREIGN PATENT DOCUMENTS

| | | | | | |
|---|---|---|---|---|---|
| JP | H07-076792 | A | | 3/1995 | |
| JP | H07-076794 | A | | 3/1995 | |
| JP | H07-238387 | A | | 9/1995 | |
| JP | H07-278880 | A | | 10/1995 | |
| JP | 07331483 | A | * | 12/1995 | ..... C25D 3/22 |
| JP | H07-316878 | A | | 12/1995 | |
| JP | H07-331457 | A | | 12/1995 | |
| JP | H07-331483 | A | | 12/1995 | |
| JP | 08024958 | A | * | 1/1996 | |
| JP | H08-074089 | A | | 3/1996 | |
| JP | H09-195082 | A | | 7/1997 | |
| JP | H09-256192 | A | | 9/1997 | |
| JP | H10-287992 | A | | 10/1998 | |
| JP | H11-6095 | A | | 1/1999 | |
| JP | 11-140684 | A | | 5/1999 | |
| JP | 2000248377 | A | * | 9/2000 | ..... C23C 28/00 |
| JP | 2007-297646 | A | | 11/2007 | |
| JP | 2016-94640 | A | | 5/2016 | |
| KR | 10-1999-0011721 | A | | 2/1999 | |
| KR | 10-2003-0042797 | A | | 6/2003 | |
| KR | 10-2004-0035129 | A | | 4/2004 | |
| KR | 10-2004-0037488 | A | | 5/2004 | |
| KR | 10-2006-0082163 | A | | 7/2006 | |
| KR | 10-0645226 | B1 | | 11/2006 | |
| KR | 10-2009-0052470 | A | | 5/2009 | |
| KR | 101173879 | B1 | * | 8/2012 | |
| KR | 10-2013-0075033 | A | | 7/2013 | |
| KR | 10-2014-0064995 | A | | 5/2014 | |
| KR | 10-2015-0073003 | A | | 6/2015 | |
| KR | 10-1786348 | B1 | | 10/2017 | |
| WO | WO-2014175420 | A1 | * | 10/2014 | ..... C23C 2/06 |
| WO | 2017/115846 | A1 | | 7/2017 | |

OTHER PUBLICATIONS

Machine translation of JPH11-6095A (published Jan. 1999), Powered by EPO and Google. (Year: 1999).*

Machine translation of KR10-1999-011721A (published Feb. 1999) by K-PION. (Year: 1999).*

Chroma Meter CR-400/410 brochure [online], Konica Minolta, Inc., [retrieved on Mar. 1, 2024]. Retrieved from the Internet: <URL: https://www.konicaminolta.eu/eu-en/hardware/measuring-instruments/colour-measurement/chroma-meters/cr-400-cr-410>. (Year: 2024).*

Understanding Standard Illuminants in Color Measurement [online blog], Konica Minolta Sensing Americas Inc. [retrieved on Mar. 2, 2024]. Retrieved from the Internet: <URL: https://sensing.konicaminolta.us/us/blog/understanding-standard-illuminants-in-color-measurement/>. (Year: 2024).*

Machine translation of KR10-1173879B1, published Aug. 14, 2012, Powered by EPO and Google. (Year: 2012).*

Machine translation of WO2014175420A1, published Oct. 2014, Powered by EPO and Google. (Year: 2014).*

International Search Report dated Mar. 16, 2021 issued in International Patent Application No. PCT/KR2020/017511 (with English translation).

Office Action issued Apr. 24, 2023 for counterpart Chinese Patent Application No. 202080088880.6.

Extended European Search Report dated Nov. 29, 2022 issued in European Patent Application No. 20902046.0.

* cited by examiner

[FIG. 1]
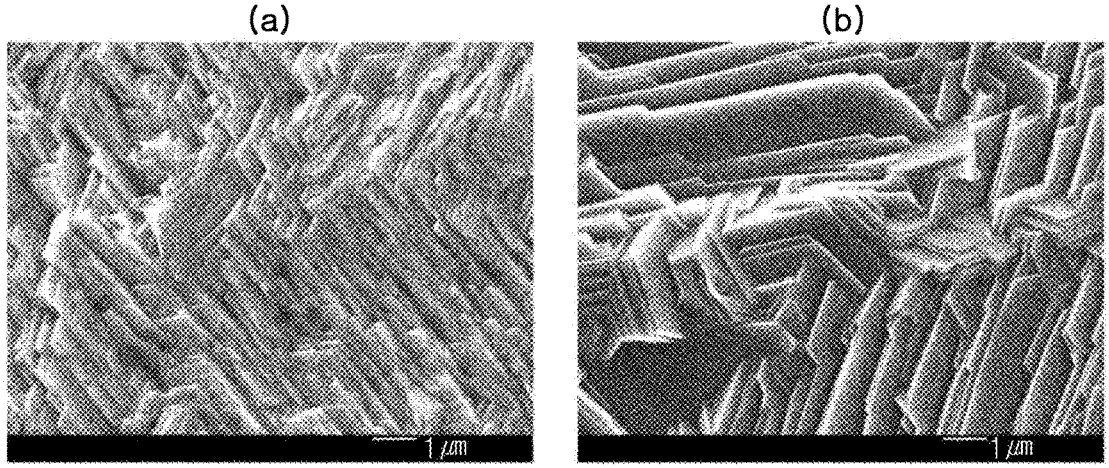

ELECTROGALVANIZED STEEL SHEET HAVING SUPERB WHITENESS AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/017511, filed on Dec. 3, 2020, which in turn claims the benefit of Korean Application No. 10-2019-0171529, filed on Dec. 20, 2019, the entire disclosures of which applications are incorporated by reference herein.

TECHNICAL FIELD

The present disclosure relates to an electrogalvanized steel sheet and a method for manufacturing same, and more particularly, an electrogalvanized steel sheet having excellent whiteness, and a method for manufacturing same.

BACKGROUND ART

An electrogalvanized steel sheet has an excellent exterior appearance, good price competitiveness, and a post-treatment such as phosphate, functional resin coating, or the like, may be easily performed thereon after electroplating, so that the electrogalvanized steel sheet may be widely used for home appliances requiring a high level of surface quality. The electrogalvanized steel sheet for home appliances is a steel sheet basically requiring physical properties such as corrosion resistance, workability, and the like, but primarily requiring an attractive exterior appearance.

Whiteness is the most important item in the surface appearance of an electrogalvanized steel sheet.

When incident light is irradiated to a surface of the steel sheet, intensity of the incident light is equal to a sum of intensity of specular reflection, diffuse reflection, and absorbed light. In recognizing a color of an object in reflected light, while specular reflection may allow a color to be recognized only from a specific angle, diffusion reflected light may allow a color to be recognized from various angles, and it is generally known that whiteness of the steel sheet is proportional to intensity of the diffuse reflection. When the intensity of the incident light is constant, in order to increase the intensity of the diffuse reflection, it is preferable to reduce specular reflection and surface absorbed light. Due to the characteristics of the electrogalvanized steel sheet, when the intensity of the specular reflection is reduced, the exterior surface is deteriorated, so that it is more preferable to minimize the surface absorbed light.

Absorption of the incident light on the surface of the steel sheet is intensified in the recessed portion when a crystal structure of the plating layer has a coarse plate-like shape, or when there are surface irregularities.

Since the surface of the electrogalvanized steel sheet is achromatic, and yellowness and redness are at negligible levels, whiteness almost coincides with a L value in a CIE L*a*b* color system of the International Lighting Commission.

Electrogalvanizing may be largely divided into a hydrochloric acid bath and a sulfuric acid bath in terms of a composition of a plating solution. For the hydrochloric acid bath, a soluble anode is usually used. Under the same temperature and concentration conditions, hydrochloric acid has a superior dissolution ability compared to sulfuric acid, and thus the electrical conductivity of the plating solution is excellent. Thus, the need to minimize a distance between electrodes through the use of an insoluble anode is low. In addition, when an insoluble anode is used, an anode and chlorine ions ($Cl^-$) may react to generate hydrochloric acid gas, which is highly toxic, and an insoluble anode film may be destroyed by chlorine ions. In general, in a hydrochloric acid bath using a soluble anode, surface whiteness of the steel sheet is low, so that use of additives is required.

On the other hand, in the case of a sulfuric acid bath, electrical conductivity of a plating solution is low, so that in order to perform a high current density operation for high-speed plating, a distance between the electrodes should be reduced, compared to the hydrochloric acid bath. To this end, an insoluble anode that does not dissolve the anode should be used, and metal zinc should be dissolved in the plating bath and supplied. In addition, zinc ions must be supplied as quickly as an amount of zinc precipitated on the steel sheet, so that pH of a plating solution must be kept low. However, when the pH is low, iron ions are eluted from the steel sheet and the eluted iron ions are co-deposited in the plating layer, thereby reducing the surface whiteness of the steel sheet and shortening a service life of the plating solution. Furthermore, when using additives in a sulfuric acid bath, there is a concern of shortening product lifespan due to reaction and damage between the insoluble anode and the additive, so that the use of additives should be limited as much as possible under the conditions of a sulfuric acid bath using a relatively expensive insoluble anode. Therefore, thorough control of impurities in the plating solution is required, and in particular, in a horizontal plating cell, there is a high risk of damage to the expensive insoluble anode due to a deflection of the steel sheet, so that caution is required during operations.

In order to secure an attractive exterior surface, that is, good whiteness, a technique for controlling a microstructure of the plating layer by adding an organic or inorganic compound to the plating solution has been proposed.

However, in this case, although it is effective in improving whiteness, there are problems in that plating current efficiency is lowered and productivity is lowered due to introduction of additional additives, and manufacturing costs are increased. In particular, in the case of a sulfuric acid bath, there is a concern of product lifespan shortening due to a reaction between the above-described additive component and an expensive insoluble anode and consequent damage to the film, so the use of the plating bath additive should be avoided as much as possible.

In addition, to date, studies have been conducted on an effect of whiteness on the surface of the steel sheet, only focusing on the composition of the plating bath, using an electrogalvanizing process and the introduction of additives, but there are insufficient studies on the pre-electroplating process and properties of the surface of the steel sheet affecting whiteness.

PRIOR ART DOCUMENT (Patent Document 1) Republic of Korea Patent Publication No. 10-2014-0064995 (published on May 28, 2014)

(Patent Document 2) Republic of Korea Patent No. 10-0645226 (published on Nov. 10, 2006)

SUMMARY OF INVENTION

Technical Problem

According to an aspect of the present disclosure, provided is an electrogalvanized steel sheet having excellent whiteness, and an attractive exterior appearance due to a reduction in surface scale, and a method for manufacturing the same.

The subject of the present invention is not limited to the above. The subject of the present invention will be understood from the overall content of the present specification, and those of ordinary skill in the art to which the present invention pertains will have no difficulty in understanding the additional subject of the present invention.

Solution to Problem

According to an aspect of the present disclosure, an electrogalvanized steel sheet may be provided. The electrogalvanized steel sheet, includes: a base steel sheet having a grains size of 10 to 20 μm in an internal structure; a nickel coating layer having an adhesion amount of 50 to 300 mg/m$^2$ provided on the base steel sheet; and a galvanized layer provided on the nickel coating layer, wherein a whiteness L value is 86.5 or more.

The electrogalvanized steel sheet may include a single resin layer or a plurality of resin layers provided on the galvanized layer.

According to another aspect of the present disclosure, a method for manufacturing an electrogalvanized steel sheet having excellent whiteness may be provided. The method includes operations of: preparing a base steel sheet having a grain size of 10 to 20 μm in an internal structure; forming a nickel coating layer having an adhesion amount of 50 to 300 mg/m$^2$ on the base steel sheet by electroplating; and forming a galvanized layer on the nickel coating layer by electroplating, wherein the galvanized layer is formed by using a galvanizing bath containing Fe ions in a concentration of less than 500 ppm; and Na, Ca, and Mg ions at a combined concentration of 50 to 150 ppm.

The method may further include an operation of forming a single resin layer or a plurality of resin layers on the galvanized layer.

The electroplating may be performed using a sulfuric acid bath.

Advantageous Effects of Invention

According to an aspect of the present disclosure, an electrogalvanized steel sheet having an attractive exterior appearance, a high degree of whiteness, and capable of securing high productivity through a high-speed operation in a process line, and a method for manufacturing the same may be provided.

BRIEF DESCRIPTION OF DRAWINGS

FIG. 1 is a result of analyzing a surface of an electrogalvanized steel sheet according to an embodiment of the present disclosure using a scanning electron microscope (SEM) at a magnification of 10,000 times, and (a) in FIG. 1 is a photograph in Inventive Example 2, and (b) in FIG. 1 is a photograph in Comparative Example 10.

BEST MODE FOR INVENTION

Hereinafter, preferred embodiments of the present disclosure will be described. The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Hereinafter, the present disclosure will be described in detail.

Hereinafter, a method for manufacturing a steel sheet of the present disclosure will be described in detail.

The method for manufacturing a steel sheet according to another aspect of the present disclosure may include operations of: preparing a base steel sheet; electroplating a nickel coating layer on the base steel sheet; and electroplating a galvanized layer on the plated nickel coating layer.

Preparing a Base Steel Sheet

Depending on the purpose of use of a final plated steel sheet, a base steel sheet provided with appropriate physical properties may be prepared. The base steel sheet of the present disclosure is not limited to a specific steel type, but a base steel sheet having a grain size of 10 to 20 μm in an internal structure may be preferable.

Since surface scale, a prominent surface defect in an electrogalvanized steel sheet, affects a subsequent metallic nickel coating amount, or the like, depending on a degree of occurrence, it is necessary to set an optimal characteristic of the base steel sheet. A grain size of the base steel sheet affects grain boundary permeation behavior of a pickling solution during pickling, thereby affecting a degree of removal of surface scales. That is, when the grain size of the base steel sheet is fine, a grain boundary permeation area of the pickling solution is increased based on the same pickling conditions (acid concentration, temperature, reaction time, or the like), thereby improving corrosion efficiency and removing the scale formed on the surface of the steel sheet becomes easy. If the acid concentration is increased or the reaction time is increased to remove a scale from the steel sheet, scale removal efficiency may be improved, but there may be a problem in that manufacturing costs may be increased or an environmental load may be increased during waste liquid treatment. Therefore, as described above, a method of improving corrosion efficiency through an increase in the reaction area between the steel sheet and the pickling solution and facilitating scale removal therethrough is preferred.

When the grain size of the internal structure of the base steel sheet is less than 10 μm, a degree of grain refinement and corrosion efficiency improvement due thereto is insignificant, but there may be a problem in that manufacturing costs may be increased due to an expensive steel-type additive element for grain refinement. However, when the grain size thereof exceeds 20 μm, there is a disadvantage in that the corrosion efficiency is deteriorated because a permeation area of the pickling solution is reduced due to grain coarsening.

Therefore, it is preferable that the grain size of the steel sheet of the present disclosure is 10 to 20 μm, and it is more preferable that the grain size is 13 to 15 μm in consideration of variables such as the content of the steel-type additive element and an effect on manufacturing cost thereof, and the pickling efficiency of the steel sheet.

The base steel sheet may be manufactured differently by changing the steel composition and content thereof, and the composition and fraction of the microstructure are not particularly limited. The base steel sheet may secure cleanliness of the surface through the pretreatment process, but in the present disclosure, the pretreatment conditions (hot rolling, pickling, cold rolling, annealing) are not particularly limited.

Forming a Nickel Coating Layer

A nickel coating layer having an adhesion amount of 50 to 300 mg/m$^2$ may be formed on the base steel sheet.

The nickel coating layer formed on the base steel sheet contributes to securing an attractive exterior surface appearance after subsequent galvanizing by hiding surface scale. As a result of analyzing the whiteness of the steel sheet according to the adhesion amount of the nickel coating layer, the surface of the steel sheet is smoothed due to an effect of providing nucleation sites of fine nickel particles as the adhesion amount thereof increases, and a size of electrodeposited particles becomes uniform and fine, so whiteness and glossiness may increase. However, when the adhesion amount thereof is excessive, it was confirmed that even if the adhesion amount thereof is increased, a degree of increase in whiteness is insignificant or, on the contrary, whiteness is reduced. In addition, in terms of crystal orientation of a zinc layer after subsequent electrogalvanizing, a degree of orientation of a base plane decreases, while a degree of orientation of a pyramid plane rapidly increases, which adversely affects other physical properties, such as corrosion resistance of the steel sheet, or the like.

When the adhesion amount of the nickel coating layer is less than 50 mg/m$^2$, there is a problem in that an effect of hiding surface scale and an effect of smoothing the surface is insufficient. On the other hand, when the adhesion amount exceeds 300 mg/m$^2$, while manufacturing costs may be increased, there is a problem in that the degree of increase in whiteness becomes insignificant or, on the contrary, whiteness decreases.

In the present disclosure, in order to form the nickel coating layer, it may be performed under normal electroplating bath conditions. A nickel coating layer is formed on the base steel plate by reacting the base steel plate with a sulfate-based nickel coating plating bath. A method of forming a nickel coating layer on one surface by circulating a plating solution after placing the base steel sheet on a negative electrode of an electroplating simulator of a vertical plating cell type may be used.

Forming Galvanized Layer

When a galvanized layer is formed, a galvanizing bath containing Fe ions in a concentration of less than 500 ppm and Na, Ca, and Mg ions at a combined concentration of 50 to 150 ppm may be used.

Meanwhile, as the galvanizing bath, a sulfuric acid-based galvanizing bath may be used.

However, in the case of the sulfuric acid bath electroplating, high concentration (98%) sulfuric acid was mainly used in the past, but in recent years, the sulfuric acid concentration has been gradually lowered due to workplace hazards, equipment corrosion, and the like. To this end, a process of diluting the high-concentration sulfuric acid, a raw material, is required, and a risk of inclusion of various ions in the plating solution increases depending on a degree of inclusion of impurities during dilution.

In the composition of the electroplating solution, it was confirmed that zinc is an element contributing to the improvement of whiteness, whereas Fe or cationic impurities such as Na, Ca, and Mg are components decreasing whiteness when the content in the plating solution increases. Other cationic impurities such as Al and K are also present in the plating solution, but the content thereof is relatively small. Therefore, in the present disclosure, impurities Na, Ca, and Mg, which have a large effect on whiteness, are controlled.

A vacancy of Fe ions, the most important factor in decreasing whiteness, is mainly affected by current density and a concentration of Fe ions in a plating solution. When the concentration of Fe ions in the plating solution is 500 ppm or more, Fe ions, present as impurities in the solution are easily precipitated due to the property of having a rare precipitation potential compared to Zn, and co-deposited in the steel sheet at the same time as zinc, resulting in significantly inferior whiteness and surface quality. In particular, since a Fe vacancy rate increases as the current density increases, a high Fe ion concentration in the plating solution acts as an obstacle during a high current density operation to ensure high productivity.

In addition, when the concentration of Na, Ca, and Mg ions is less than 50 ppm, conductivity of the plating solution decreases, making it difficult to secure high current density. When the concentration of Na, Ca, and Mg ions exceeds 150 ppm, Fe ion vacancies are promoted, so that the surface quality may be deteriorated, such as a decrease in whiteness.

In addition, when a content of zinc in the plating solution is large, the zinc content is also very important since zinc interferes with Fe vacancy. However, the zinc content is not particularly limited in the present disclosure.

In the present disclosure, in order to form the galvanized layer, it may be performed under normal electroplating bath conditions. The steel sheet on which the nickel coating layer is formed reacts with a sulfuric acid-based galvanizing bath to form a galvanized layer. A method of forming a galvanized layer on one surface by circulating a plating solution after placing a steel sheet on a cathode of an electroplating simulator of a vertical plating cell type may be used.

After forming the galvanized layer, a single resin layer or a plurality of resin layers may be formed as needed.

The steel sheet manufactured by the above-described manufacturing method may include: a base steel sheet having a grain size of 10 to 20 μm in an internal structure; a nickel coating layer having an adhesion amount of 50 to 300 mg/m$^2$ provided on the base steel sheet; and a galvanized layer provided on the nickel coating layer.

In the electrogalvanized steel sheet manufactured as described above, when a degree of occurrence of surface scale is visually confirmed, it is not observed, and a whiteness L value of 86.5 or more may be secured. An attractive exterior appearance, a high degree of whiteness, and high productivity may be secured through a high-speed operation in a process line.

Hereinafter, the present disclosure will be described in more detail through examples. However, it is necessary to note that the following examples are only intended to illustrate the present disclosure in more detail and are not intended to limit the scope of the present disclosure.

MODE FOR INVENTION

Example

Base steel sheets (ultra-low carbon steel) having different grain sizes, with a thickness of 0.6 mm, a width of 140 mm, and a length of 250 mm, to which the same pre-treatment (hot rolling, pickling, cold rolling, annealing) conditions were applied, were manufactured. Thereafter, a nickel coating layer and a galvanized layer were sequentially formed on the base steel sheet through electroplating after degreasing and pickling treatment. In this case, a nickel coating layer and a galvanized layer were formed on one surface by circulating a sulfuric acid-based plating solution after placing the base steel sheet on a negative electrode of a vertical plating cell-type electroplating simulator. In this case, an adhesion amount of the nickel coating layer was controlled by varying an energization time under the same current density (10 A/dm$^2$) and an electrolytic flow rate (1.5 m/s) according to a degree of occurrence of surface scale. In the case of zinc plating formed on the nickel coating layer, the same current density (100 A/dm$^2$), electrolytic flow rate (1.5 m/s), and energization time (7 seconds) were applied to secure 20 g/m$^2$, a target adhesion amount. In addition, a degree of influence of major components such as Fe, Na, Ca, Mg, and the like, in the plating solution during zinc plating was simultaneously confirmed. The adhesion amount of the nickel coating layer and the galvanized layer was confirmed by an X-ray fluorescence analyzer (XRF), each of which having a calibration curve input, and by dissolving a plating layer using a wetting method, and then measuring a difference in weight before and after using an ultra-precision scale. The manufacturing conditions of each specimen are illustrated in Table 1 below.

TABLE 1

| Specimen No. | Base steel sheet | Ni coating | | | | Zn plating | | | | Zn plating solution component | | |
|---|---|---|---|---|---|---|---|---|---|---|---|---|
| | Grain size (μm) | Current density (A/dm$^2$) | Flow rate (m/s) | Energization time (second) | Adhesion amount (mg/m$^2$) | Current density (A/dm$^2$) | Flow rate (m/s) | Energization time (second) | Adhesion amount (mg/m$^2$) | Zn (g/l) | Fe (ppm) | Na + Ca + Mg (ppm) |
| 1 | 12 | 10 | 1.5 | 2 | 94.9 | 100 | 1.5 | 7 | 19.8 | 62 | 235 | 118 |
| 2 | 15 | 10 | 1.5 | 2 | 94.9 | 100 | 1.5 | 7 | 19.8 | 62 | 268 | 123 |
| 3 | 19 | 10 | 1.5 | 2 | 94.9 | 100 | 1.5 | 7 | 19.8 | 62 | 292 | 109 |
| 4 | 15 | 10 | 1.5 | 1.5 | 58.0 | 100 | 1.5 | 7 | 19.8 | 62 | 268 | 123 |
| 5 | 15 | 10 | 1.5 | 4 | 224.7 | 100 | 1.5 | 7 | 19.8 | 62 | 268 | 123 |
| 6 | 15 | 10 | 1.5 | 5 | 285.0 | 100 | 1.5 | 7 | 19.8 | 62 | 268 | 123 |
| 7 | 15 | 10 | 1.5 | 2 | 94.9 | 100 | 1.5 | 7 | 19.8 | 62 | 359 | 123 |
| 8 | 15 | 10 | 1.5 | 2 | 94.9 | 100 | 1.5 | 7 | 19.8 | 62 | 478 | 123 |
| 9 | 15 | 10 | 1.5 | 2 | 94.9 | 100 | 1.5 | 7 | 19.8 | 62 | 387 | 68 |
| 10 | 15 | 10 | 1.5 | 2 | 94.9 | 100 | 1.5 | 7 | 19.8 | 62 | 387 | 92 |
| 11 | 15 | 10 | 1.5 | 2 | 94.9 | 100 | 1.5 | 7 | 19.8 | 62 | 387 | 141 |
| 12 | 23 | 10 | 1.5 | 2 | 94.9 | 100 | 1.5 | 7 | 19.8 | 62 | 275 | 115 |
| 13 | 25 | 10 | 1.5 | 2 | 94.9 | 100 | 1.5 | 7 | 19.8 | 62 | 258 | 105 |
| 14 | 30 | 10 | 1.5 | 2 | 94.9 | 100 | 1.5 | 7 | 19.8 | 62 | 302 | 125 |
| 15 | 23 | 10 | 1.5 | 2 | 285.0 | 100 | 1.5 | 7 | 19.8 | 62 | 275 | 115 |
| 16 | 25 | 10 | 1.5 | 2 | 285.0 | 100 | 1.5 | 7 | 19.8 | 62 | 258 | 105 |
| 17 | 30 | 10 | 1.5 | 2 | 285.0 | 100 | 1.5 | 7 | 19.8 | 62 | 302 | 125 |
| 18 | 15 | 10 | 1.5 | 1 | 31.8 | 100 | 1.5 | 7 | 19.8 | 62 | 268 | 123 |
| 19 | 15 | 10 | 1.5 | 6 | 340.1 | 100 | 1.5 | 7 | 19.8 | 62 | 268 | 123 |
| 20 | 15 | 10 | 1.5 | 2 | 94.9 | 100 | 1.5 | 7 | 19.8 | 62 | 523 | 123 |
| 21 | 15 | 10 | 1.5 | 2 | 94.9 | 100 | 1.5 | 7 | 19.8 | 62 | 387 | 167 |

For the electrogalvanized steel sheet prepared as described above, a degree of occurrence of surface scale on a surface of the steel sheet was visually confirmed, and whiteness was measured with a Minolta CR-400 colorimeter, and results thereof were shown in Table 2 below. Meanwhile, for some specimens confirmed to have inferior whiteness, a peak obtained after irradiating the specimen with an acceleration voltage of 40 kV using Cu Kα radiation with an X-ray diffraction analyzer (Rigaku, D/MAX 2500V/PC) to determine the cause was analyzed, and a plating structure was analyzed with a JEOL's JSM-7001F field emission scanning electron microscope (FE-SEM).

TABLE 2

| Specimen No. | Whether or not surface scale is observed | Whiteness (L) | Classification |
|---|---|---|---|
| 1 | Not occur | Excellent (88.0 or more and less than 89.5) | Inventive Example 1 |
| 2 | Not occur | Excellent (88.0 or more and less than 89.5) | Inventive Example 2 |

TABLE 2-continued

| Specimen No. | Whether or not surface scale is observed | Whiteness (L) | Classification |
|---|---|---|---|
| 3 | Not occur | Excellent (88.0 or more and less than 89.5) | Inventive Example 3 |
| 4 | Not occur | Excellent (88.0 or more and less than 89.5) | Inventive Example 4 |
| 5 | Not occur | Excellent (88.0 or more and less than 89.5) | Inventive Example 5 |
| 6 | Not occur | Excellent (88.0 or more and less than 89.5) | Inventive Example 6 |

TABLE 2-continued

| Specimen No. | Whether or not surface scale is observed | Whiteness (L) | Classification |
|---|---|---|---|
| 7 | Not occur | Excellent (88.0 or more and less than 89.5) | Inventive Example 7 |
| 8 | Not occur | Very good (86.5 or more and less than 88.0) | Inventive Example 8 |
| 9 | Not occur | Excellent (88.0 or more and less than 89.5) | Inventive Example 9 |
| 10 | Not occur | Excellent (88.0 or more and less than 89.5) | Inventive Example 10 |
| 11 | Not occur | Very good (86.5 or more and less than 88.0) | Inventive Example 11 |
| 12 | Occur | Very good (86.5 or more and less than 88.0) | Comparative Example 1 |
| 13 | Occur | Very good (86.5 or more and less than 88.0) | Comparative Example 2 |
| 14 | Occur | Normal (85.0 or more and less than 86.5) | Comparative Example 3 |
| 15 | Occur | Normal (85.0 or more and less than 86.5) | Comparative Example 4 |
| 16 | Occur | Normal (85.0 or more and less than 86.5) | Comparative Example 5 |

TABLE 2-continued

| Specimen No. | Whether or not surface scale is observed | Whiteness (L) | Classification |
|---|---|---|---|
| 17 | Occur | Insufficient (less than 85.0) | Comparative Example 6 |
| 18 | Occur | Excellent (88.0 or more and less than 89.5) | Comparative Example 7 |
| 19 | Not occur | Normal (85.0 or more and less than 86.5) | Comparative Example 8 |
| 20 | Not occur | Insufficient (less than 85.0) | Comparative Example 9 |
| 21 | Not occur | Insufficient (less than 85.0) | Comparative Example 10 |

As can be seen from Tables 1 and 2, it can be confirmed, in Inventive Examples 1 to 11 satisfying the conditions disclosed in the present disclosure, the electrogalvanized steel sheet has excellent surface quality and whiteness. However, in the case of Comparative Examples 1 to 10, it can be confirmed that an excellent level of surface quality and whiteness may not be secured since the conditions disclosed by the present disclosure are not satisfied. In the present disclosure, if a whiteness L value is 88.0 or more and less than 89.5, it was described as "excellent", if the whiteness L value was 86.5 or more and less than 88.0, it was described as "very good", if the whiteness L value was 85.0 or more and less than 86.5, it was described as "normal", and if the whiteness L value is less than 85.0, it was described as "insufficient".

FIG. 1 is a result of analyzing a surface of an electrogalvanized steel sheet according to an embodiment of the present disclosure using a scanning electron microscope (SEM) at a magnification of 10,000 times, and (a) in FIG. 1 is a photograph of Inventive Example 2, and (b) in FIG. 1 is a photograph of Comparative Example 10. As illustrated in FIG. 1, it can be seen that, in Inventive Example (a), a grain and orientation of a plating structure are very uniform. On the other hand, in the case of Comparative Example (b), it can be seen that a size of the grain is relatively large and irregular, and a plate-like structure is greatly developed, so that an incident light absorption area is large. In addition, in terms of crystal orientation, it can be confirmed that surface quality is not excellent because a pyramid plane orientation fraction is high compared to base plane orientation.

In the case of Comparative Examples 1 to 6, it can be seen that removal efficiency of a hot-rolled scale formed on a surface of the steel sheet during pickling is lowered due to a coarse grain size as a grain size of the base steel sheet proposed by the present disclosure is not satisfied, so that surface scale is observed on a surface of the steel sheet after galvanizing. For this reason, excellent surface quality could not be secured. In particular, in the case of Comparative Example 6, the grain size was very coarse, so it can be seen that a width of a decrease in whiteness due to an excessive increase in the adhesion amount of the nickel coating is relatively large.

In the case of Comparative Examples 7 and 8, since a nickel coating adhesion amount suggested by the present invention was not satisfied, excellent surface quality and whiteness were not secured at the same time. In particular, in the case of Comparative Example 7 in which the nickel coating adhesion amount is very small, the surface quality is inferior due to an insufficient hiding effect of the surface scale, and in the case of Comparative Example 8 in which the nickel coating adhesion amount is excessive, the surface scale was not observed, but it was confirmed that whiteness was decreased.

In Comparative Examples 9 and 10, it can be seen that the electrogalvanized steel sheet may not secure excellent whiteness because the conditions for a sum of Fe ions and Na, Ca, and Mg concentrations in the plating solution proposed by the present disclosure were not satisfied. In particular, in the case of Comparative Example 9, in which the Fe ion concentration itself is high, and in Comparative Example 10, in which cationic impurities such as Na, Ca, and Mg are present in an excess amount even at an appropriate Fe concentration, it can be seen that Fe vacancies in the plating layer are promoted, so that whiteness is insufficient to an insufficient level.

While example embodiments have been shown and described above, it will be apparent to those skilled in the art that modifications and variations could be made without departing from the scope of the present disclosure as defined by the appended claims.

The invention claimed is:

1. An electrogalvanized steel sheet having excellent whiteness, comprising:

a base steel sheet having a grain size of 10 to 20 μm in an internal structure;

a nickel coating layer having an adhesion amount of 50 to 300 $mg/m^2$ provided on the base steel sheet; and a galvanized layer provided on the nickel coating layer, wherein the galvanized layer is formed from a galvanizing bath that includes Fe ions in a concentration of less than 500 ppm, and Na, Ca, and Mg ions at a combined concentration of 50 to 150 ppm, and wherein a whiteness L value is 88.0 or more measured by a Minolta CR-400 colorimeter, and the whiteness is measured based in the galvanized layer.

2. The electrogalvanized steel sheet having excellent whiteness of claim 1, wherein the electrogalvanized steel sheet comprises a single or a plurality of resin layers provided on the galvanized layer.

3. The electrogalvanized steel sheet having excellent whiteness of claim 1, wherein the whiteness L value is less than 89.5 measured by the Minolta CR-400 colorimeter.

* * * * *